US006863091B2

(12) United States Patent
Wahhoud

(10) Patent No.: US 6,863,091 B2
(45) Date of Patent: Mar. 8, 2005

(54) METHOD FOR CONTROLLING THE SHED IN A LOOM WITH FLUIDIC WEFT INSERTION

(75) Inventor: Adnan Wahhoud, Lindau (DE)

(73) Assignee: Staubli Faverges, Faverges (FR)

( * ) Notice: Subject to any disclaimer, the term of this patent is extended or adjusted under 35 U.S.C. 154(b) by 155 days.

(21) Appl. No.: 10/268,334

(22) Filed: Oct. 9, 2002

(65) Prior Publication Data

US 2003/0070721 A1 Apr. 17, 2003

(30) Foreign Application Priority Data

Oct. 10, 2001 (DE) ..... 101 49 970

(51) Int. Cl.[7] ..... D03D 47/32
(52) U.S. Cl. ..... 139/435.1; 139/55.1
(58) Field of Search ..... 139/55.1, 59, 435.1, 139/85, 93

(56) References Cited

U.S. PATENT DOCUMENTS 5,390,709 A * 2/1995 Martonffy ..... 139/456

FOREIGN PATENT DOCUMENTS

| | | |
|---|---|---|
| EP | 0353005 | 1/1990 |
| EP | 0697477 | 2/1996 |

* cited by examiner

*Primary Examiner*—John Calvert
*Assistant Examiner*—Brian Kauffman
(74) *Attorney, Agent, or Firm*—Dowell & Dowell, P.C.

(57) ABSTRACT

The shed of a fluidic weaving loom is not changed simultaneously for all warp threads, but rather continuously starting at the weft entrance and continuing helically, so to speak, to the exit of the warp shed. This sequential shed closure takes place with a so-called domino effect along a helical line curved in space, whereby additional time is gained for stretching the inserted weft thread and temporarily stopping the shed formation or shedding is avoided.

6 Claims, 3 Drawing Sheets

FIG.1
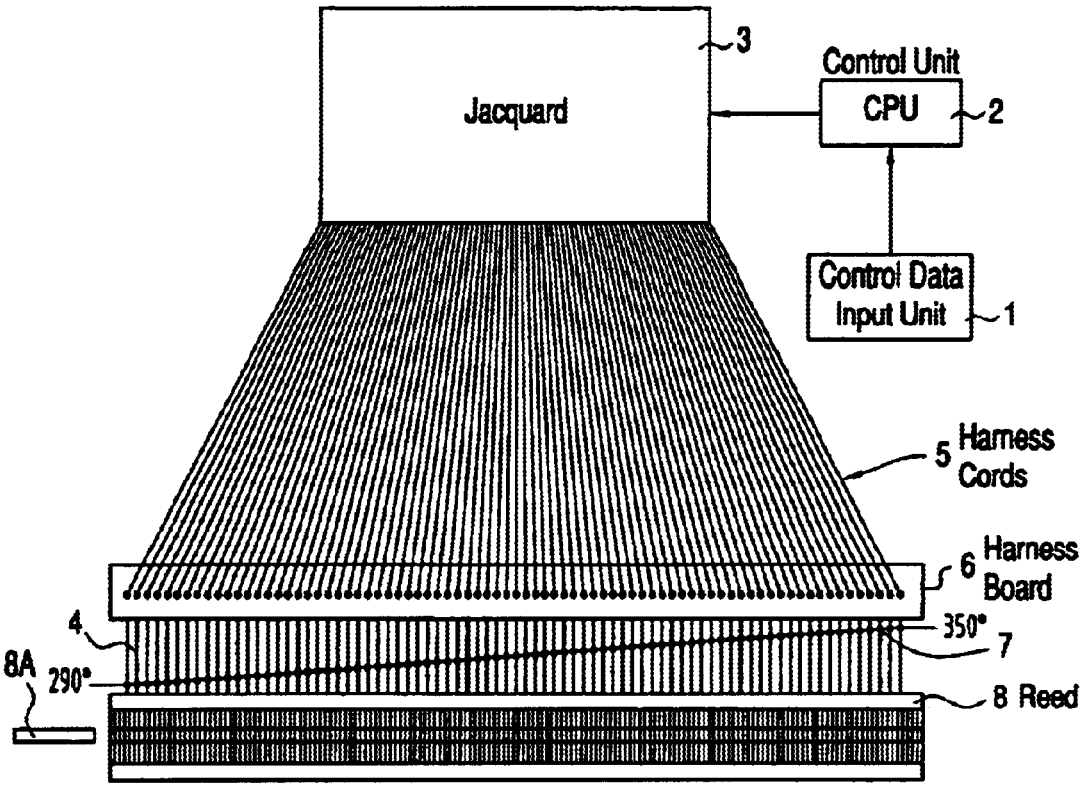
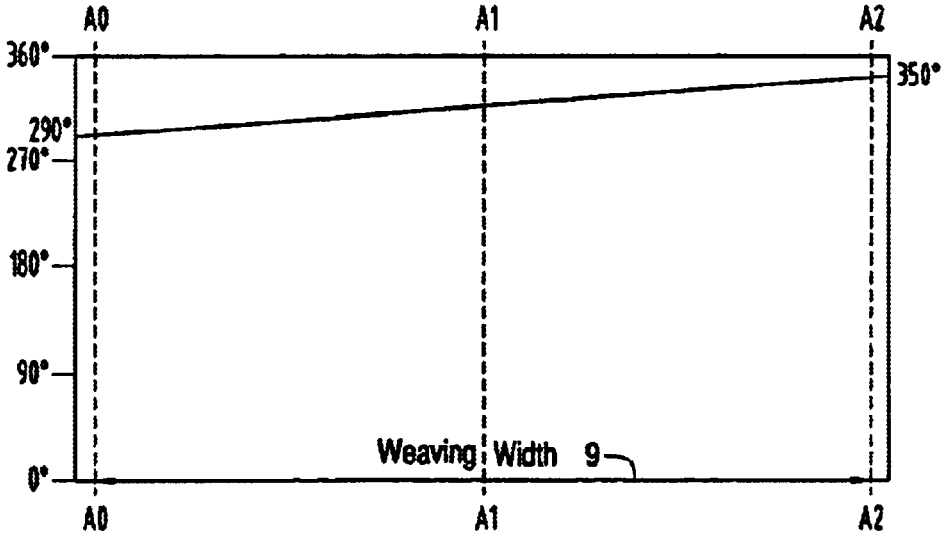
FIG.2

METHOD FOR CONTROLLING THE SHED IN A LOOM WITH FLUIDIC WEFT INSERTION

PRIORITY CLAIM

The application is based on and claims priority under 35 U.S.C. §119 of German Patent Application 101 49 970.1-26, filed on Oct. 10, 2001 in the Federal Republic of Germany. The entire disclosure of the German Patent Application is incorporated herein by reference.

CROSS-REFERENCE TO RELATED APPLICATION

This application is related to U.S. Patent Application for: Method for Controlling the Shed in a Loom With Mechanical Weft Insertion (Attorney's Docket No. 4411); by the present inventor. The related application is filed concurrently with the present application. The entire disclosure of the related application is incorparated herein by reference.

FIELD OF THE INVENTION

The invention relates to a method for controlling the warp shed formation and warp shed closure with the aid of a jacquard that is part of a weaving loom. The weft threads are inserted into the open warp shed by at least one fluidic nozzle. One main nozzle is positioned at an entrance to the warp shed. Auxiliary nozzles are positioned along the warp shed or along the fluidic weft insertion channel.

BACKGROUND INFORMATION

Weaving looms with a fluidic weft thread insertion for producing a fabric having a predetermined fabric pattern are operated in combination with a jacquard which controls the repeated shed formation of the warp threads. One weaving cycle includes an opening of a warp shed, an insertion of a weft thread into the warp shed and closing of the warp shed followed by a beat-up of the inserted weft by a reed against the fabric. A fluidic weft insertion by one or more nozzles such as air jet nozzles requires a special attention to the shed formation to avoid damaging the warp threads by the jets and to optimally control the shed formation along the weaving width defined between a weft entrance and a weft exit of the warp shed.

A jacquard of modern construction comprises a plurality of electrically or electronically controllable warp lifting and lowering components or drives which, for example, are driven by controllable electric motors. Such jacquards do not comprise any knives nor any drives for such knives.

Each warp thread of all warp threads in the loom is guided and driven by the jacquard operating components including harness cords, etc., which lift and lower the respective warp thread through coupling elements which connect the harness cords with respective drives and with heddles and pull back members to move each of the warp threads. Each harness cord and its pull back member are guided and driven by a respective individual operating component or drive motor in such a way that the warp shed is formed by the warp threads. For this purpose one group of warp threads is moved vertically from a first upper position to a second lower position while another group of warp threads is simultaneously vertically moved from the second lower position to the first upper position to thereby form the warp or loom shed. An electronic control or CPU is provided for the controlled motion of the warp threads for the shed formation and respective shed closure. The electronic control drives each of the warp operating components such as electric motors in accordance with a preselected program by transmitting signals from the control unit, for example, to the above mentioned individual electric motors for driving or moving the warp threads for the proper shed formation also referred to as shedding.

European Patent Publication EP 0,353,005 B2 (Palmer) discloses an example of a weaving loom with a drive mechanism that performs the function of a jacquard as described above. Each individual warp thread is moved by its heddle and a respective heddle actuator between end positions which are variable in accordance with a fabric pattern representing program stored in the memory of a computer. The operation is such that a preselected pattern is formed in the textile being woven. The control data stored in the computer memory represent selected operating parameters that result in an "oblique or parabolic shedding" during the weaving operation.

The disclosure of the European Patent Publication EP 0,353,005 B2 does not provide for different shed formation configurations for different types of looms such as mechanical looms with a weft insertion by two rapiers or fluid jet looms with a fluidic weft insertion by fluid nozzles for transporting a weft thread through the warp or loom shed having an entrance and an exit. Thus, the shedding or the shed motion profiles for the same fabric pattern are identical, namely oblique or parabolic for a loom with mechanical weft insertion and for a loom with pneumatic weft insertion. The use of either oblique or parabolic shedding in any type of loom does not take into account that different types of looms have different shedding requirements for achieving an optimal weaving operation.

OBJECTS OF THE INVENTION

In view of the foregoing it is the aim of the invention to achieve the following objects singly or in combination:

- to control the shed motion profile or shedding in accordance with the requirements of a loom with a fluidic weft insertion;
- to control the motion of individual heddles in such a way that in a loom with a fluidic weft insertion by a nozzle or nozzles, the shed motion profile or shedding permits a safe operation of the weft insertion nozzle or nozzles with substantially no damage to the warp threads by the jet or jets;
- to provide an increased operational life for the components that operate the heddles including the warp pull back elements;
- to reduce the wear and tear on the warp threads and of the heddle driving components and pull back elements to thereby increase the operational life of weaving looms with a fluidic weft insertion while gently handling or driving the warp threads for the shed formation;
- to increase the time duration of keeping a shed open in a weaving loom with a fluidic weft insertion, in such a way that more time is available for stretching the fluidically inserted weft thread as it passes through the weft insertion channel as compared to the prior art;
- to increase the opening time of the so-called weft insertion window in a weaving cycle; and
- to provide a gentle fluidic weft transport while simultaneously improving the stretching of the weft thread to thereby also improve the fabric quality.

SUMMARY OF THE INVENTION

The above objects have been achieved according to the invention by a method which takes shedding requirements of a loom with fluidic weft insertion into account for operating the individual heddles in a heald shaft in response to electronic control data stored in a computer memory or respective signals provided by a control unit. The data for individually or separately controlling the lifting and lowering of the warp threads take into account a safe timing that depends on the angular rotation of the main drive shaft of the loom, for the warp thread positions relative to influence areas of the weft inserting jet or jets along the weaving width of the loom corresponding to the weft insertion channel length. According to the invention the driving of the individual heddles depends on the instantaneous angular rotational position of a main loom drive shaft in such a manner that a shed stop is avoided entirely along the weaving width from a weft entrance of the warp shed to a weft exit of the warp shed, and further so that a shed closure starts at the weft entrance and proceeds continuously and sequentially to the weft exit of the warp shed, and so that the shedding motion of the warp threads follows a curve that twists in space as a helix whereby a domino effect motion is achieved.

According to the invention the heddle operating components are controlled, following the fluidic insertion of the weft thread into an open shed, in such a manner that over the weaving widths the shed closing for each individual weft thread advances continuously in response to an instantaneous angular position of the main drive shaft of the loom. Stated differently the shed closure for each individual weft thread begins at the weft entrance and is then shifted along the open shed from the entrance to the exit of the shed in a continuous manner.

Thus, at the exit of the weft insertion channel the shed is closed later than at the entrance of the shed, namely at a point of time which corresponds to a larger rotational angle of the main loom drive shaft than the rotational angle at the beginning of the shed closure at the weft entrance. As a result the total shed closing time is about 25% longer than in conventional fluidic looms, whereby this time can be advantageously utilized to sufficiently stretch the inserted weft thread already at the beginning of the shed enclosure.

The invention achieves the advantage not only of the just mentioned increased time interval, but it also permits a gentle weft inserted combined with an improved stretching action applied to the weft thread which in turn results in an improved weaving or fabric quality.

According to a further embodiment of the invention a continuous angle of rotation displacement within a define dangle of rotation range of the main drive shaft of the loom is less than or at the most 100°, preferably this angular range is about 60°.

According to the invention the control of the operating components for closing the shed in response to the angular rotation of the main loom drive shaft begins at about 290° at the weft entrance of the shed which makes possible an early weft insert start and an early stretching. The end of this angle of rotation dependent control at the weft exit of the shed takes place at about 350°, whereby the stretching phase or time duration for stretching the weft thread is maximally or rather optimally increased as mentioned above.

More specifically, according to the present method the following steps are performed:

(a) allocating to said given weaving width of said weaving loom a weft entrance A0 at a shed entrance, a shed center A1, and a weft exit A2 at a shed exit, (b) fluidically inserting each weft thread into said warp shed from the shed entrance to the shed exit, (c) generating reference signals based on angular degrees of rotation of the main loom drive shaft, (d) providing separate heddle motion control signals for each of the individually controllable heddle drives, and (e) separately controlling each of the heddle drives by separate heddle motion control signals in response to the angular reference signals so that a closure of said warp shed begins at said weft entrance A0, proceeds continuously through said warp shed past said shed center A1 and ends at said shed exit A2 of said warp shed, whereby a respective shedding motion of all heddles sequentially follows a curve resembling a helically curved domino effect.

BRIEF DESCRIPTION OF THE DRAWINGS

In order that the invention may be clearly understood, it will now be described in connection with example embodiments, with reference to the accompanying drawings, wherein:

FIG. 1 shows schematically components of a loom with a fluidic weft insertion and a shed forming jacquard which controls the shed formation according to the method of the invention;

FIG. 2 illustrates three points along the abscissa or weaving width including a weft entrance, a shed center, and a weft exit along the warp shed of the loom with a fluidic weft insertion, whereby the ordinate shows the angle of rotation of the main loom drive shaft;

Figure 3:
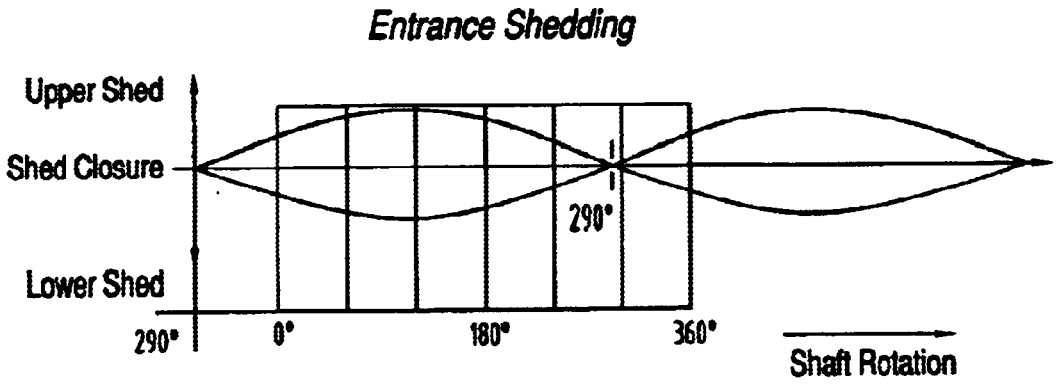
FIG. 3 illustrates continuous curves representing a warp motion or shedding profile in a weft entrance section of the loom, whereby the abscissa shows degrees of rotation of the main loom drive shaft.

DETAILED DESCRIPTION OF PREFERRED EXAMPLE EMBODIMENTS AND OF THE BEST MODE OF THE INVENTION

FIG. 1 shows a schematic arrangement of the components of a loom with a fluidic weft insertion required for explaining the invention. A control data input unit such as a keyboard 1 is operatively connected to a central processing and control unit 2 which in turn is operatively connected to a jacquard 3 that individually controls the lifting and lowering of heddles 4 through respective harness cords 5. The harness cords 5 run through a harness board 6 and move the heddles 4 including warp holders 7, for example in the form of heddle hooks or heddle eyes for the shed formation simply referred to as shedding. At least one warp thread runs through each heddle eye 7.

In FIG. 1 all heddle eyes 7 are shown in a position along a dotted and slanted line extending between 290° at a weft entrance and 350° at a weft exit of the warp shed. These degrees represent rotation of a main loom drive shaft shown symbolically in FIG. 6 to be described below. A reed 8 performs a conventional weft beat-up motion, when the shed is entirely closed at 350° of one revolution of the main loom drive shaft as indicated by the dotted and slanted line in FIG.

1. A weft inserting nozzle 8*a* is positioned symbolically at the entrance of the loom shed formed by the warp threads.

FIG. 2 shows that a weaving width 9 and thus the warp shed of the loom has a weft entrance A0, a shed center A1 and a weft exit A2. The ordinate in FIG. 2 represents the 360° of one revolution of the main loom drive shaft. The slanted line between 290° and 350° of shaft rotation corresponds to the slanted dotted line shown in FIG. 1 and indicates the shed closure motion sequentially from the weft entrance A0 through the shed center A1 to the shed exit A2. The dashed lines A0—A0; A1—A1 and A2—A2 represent pairs of warp threads, each pair including an upper shed warp thread and a lower shed warp thread. These pairs of warp threads are respectively positioned at the weft entrance A0, at the shed center A1 and at the weft exit A2 of the warp shed. Shed closure begins at 290° and ends at 350° thereby covering a range of 60° of main shaft rotation. The shed closure follows actually a curve in space rather than a straight line in a plane. The curve in space is a helix that represents a domino effect as one pair of warp threads after the other closes the warp shed.

Figure 4:
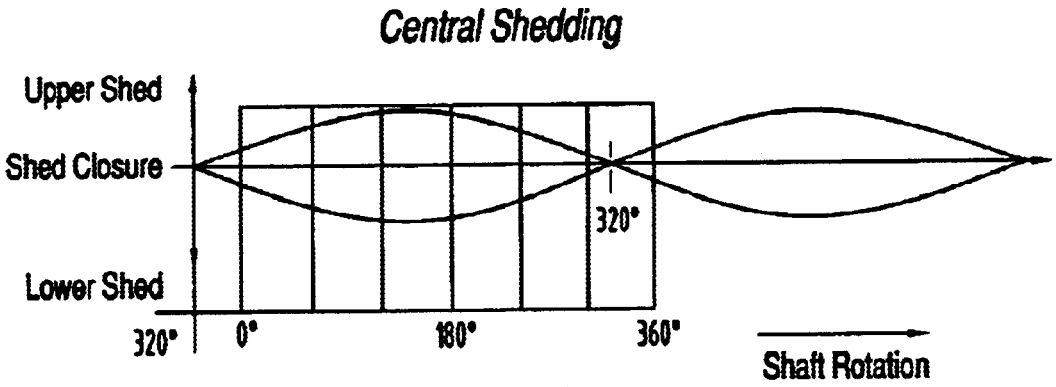
FIG. 4 illustrates continuous curves representing a warp motion or shedding profile in a central shed section between the shed entrance and the shed exit, whereby the abscissa shows degrees of rotation of the main loom drive shaft.
Figure 5:
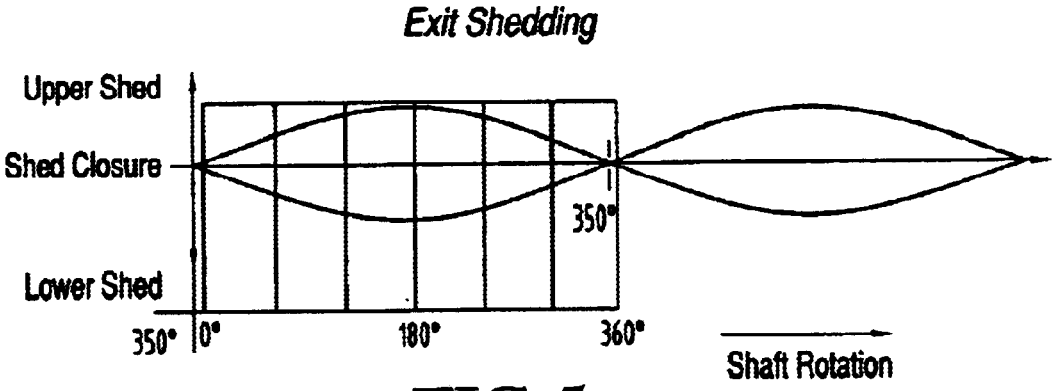
FIG. 5 illustrates continuous curves representing a warp motion or shedding profile in a shed exit section, whereby the abscissa shows degrees of rotation of the main loom drive shaft.

FIGS. 3, 4 and 5 show shed closure curves or motion profiles as a function of shaft rotation. FIG. 3 relates to shedding at a shed entrance with a shed closure at 290°. FIG. 4 relates to shedding at a shed center with a shed closure at 320°. FIG. 5 relates to shedding at a shed exit with a shed closure at 350°. Thus, the respective shed closures are phase shifted in 30° steps from the entrance A0 to the exit A2 of the warp shed without any stopping of the shed formation. The shed closure profiles assume sinusoidal curve configurations and represent continuous shed motions without any shed stops to gain extra time for an effective, but gentle weft stretching.

Figure 6:
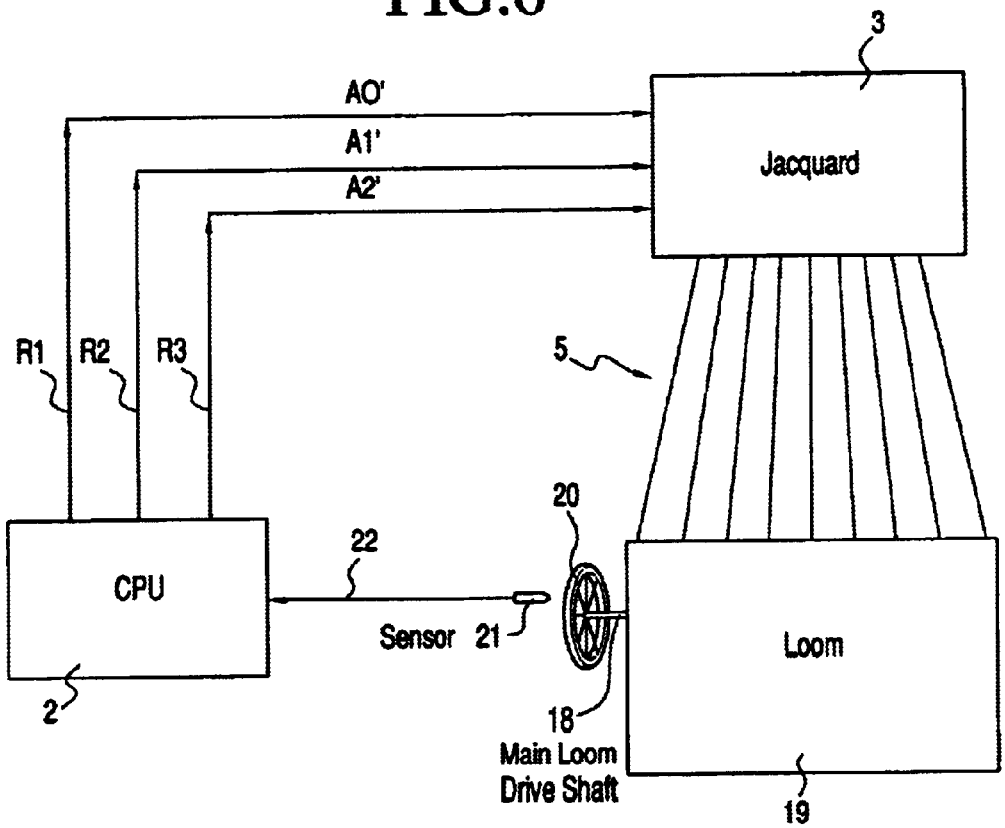
FIG. 6 shows a block circuit diagram for generating a reference signal or signals based on the angular degrees of rotation of the main loom drive shaft.

FIG. 6 shows a block diagram for generating reference signals that represent the angles of rotation of a main drive shaft 18 of a loom 19. The angle information is produced by a strobe generator 20. A sensor 21 feeds strobe pulses on a conductor 22 to an input of the central control 2 also shown in FIG. 1. The central control 2 generates at least three separate reference signals R1, R2, R3 that are supplied to the jacquard 3 at three different inputs A0', A1' and A2' which are allocated to the respective weaving width locations A0, A1 and A2, namely at the shed entrance A0, shed center A1, and shed exit A2.

The central control 2 correlates or synchronizes the control signals for operating the individual harness cords 5 with the reference signals. Thus, the respective heddles and accordingly the corresponding warp threads are moved up or down and the shed is precisely closed at the intended angular positions 290°, 320° and 350° of the main loom drive shaft 18 as illustrated in FIGS. 3, 4 and 5.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for controlling a warp shed in a weaving loom having a fluidic weft insertion, a main loom drive shaft and a given weaving width, said weaving loom further including a plurality of heddles and a respective plurality of individually controllable heddle drives so that each heddle has its own drive, said method comprising the following steps:

(a) allocating to said given weaving width of said weaving loom a weft entrance (A0) at a shed entrance, a shed center (A1), and a weft exit (A2) at a shed exit, (b) fluidically inserting each weft thread into said warp shed from said shed entrance to said shed exit, (c) generating reference signals based on angular degrees of rotation of said main loom drive shaft, (d) providing separate heddle motion control signals for each of said individually controllable heddle drives, and (e) separately controlling each of said heddle drives by said separate heddle motion control signals in response to said angular reference signals so that a closure of said warp shed begins at said weft entrance (A0), proceeds continuously through said warp shed past said shed center (A1) and ends at said shed exit (A2) of said warp shed, whereby a respective shedding motion of all heddles sequentially follows a curve resembling a helically curved domino effect without stopping the shedding.

2. The method of claim 1, comprising applying said separate heddle motion control signals within an angular range of 100° at the most of said rotation of said main loom drive shaft.

3. The method of claim 2, wherein said angular range of said rotation of said main loom drive shaft is 60°.

4. The method of claim 1, wherein said applying of said separate heddle motion control signals begins at about 290° of one revolution of said main loom drive shaft and ends at about 350° of said one revolution of said main loom drive shaft.

5. The method of claim 1, wherein said separate heddle motion control signals are applied so that warp thread holders of said heddles assume a position along a sinusoidal curve between said shed entrance and said shed exit and along said given weaving width.

6. The method of claim 1, wherein a first shed closure point of time of a first pair of warp threads at said shed entrance (A0), a second shed closure point of time of a second pair of warp threads at said shed center (A1) and a third shed closure point of time of a third pair of warp threads at said shed exit (A2) are spaced from each other by a time duration corresponding to 30° of rotation of said main loom dive shaft.

* * * * *